United States Patent [19]

Chromy

[11] Patent Number: 4,611,670

[45] Date of Patent: Sep. 16, 1986

[54] MOTOR DRIVEN DRILLING OR CHIPPING DEVICE

[75] Inventor: Franz Chromy, Levis, Austria

[73] Assignee: Hilti Aktiengesellschaft

[21] Appl. No.: 616,543

[22] Filed: Jun. 1, 1984

[30] Foreign Application Priority Data

Jun. 6, 1983 [DE] Fed. Rep. of Germany ..... 3320426

[51] Int. Cl.[4] ..... F21C 3/00

[52] U.S. Cl. ..... 175/116; 173/104; 173/DIG. 3

[58] Field of Search ..... 173/116, 117, DIG. 3, 173/104, 107, 118

[56] References Cited

U.S. PATENT DOCUMENTS 2,702,534 2/1955 Keylwert .
3,376,939 4/1968 Holzappel ..... 173/116
3,929,195 12/1975 Stiltz et al. ..... 173/116 X
4,183,414 1/1980 Tamai et al. ..... 173/DIG. 3 X

FOREIGN PATENT DOCUMENTS 1158051 7/1969 United Kingdom .

*Primary Examiner*—E. R. Kazenske
*Assistant Examiner*—Willmon Fridie, Jr.
*Attorney, Agent, or Firm*—Toren, McGeady, Stanger, Goldberg & Kiel

[57] ABSTRACT

In a motor driven drilling or chipping device, a housing forms a sealed housing space containing a gear arrangement and an air cushion propulsion mechanism driven by the gear arrangement. The housing space is partially filled with lubricating oil. A pressure equalizing nozzle has a bore connecting the interior of the housing space to the ambient atmosphere outside the housing. The port at the end of the nozzle bore communicating with the housing space is enclosed by wall members forming a stilling chamber. The stilling chamber is in communication with the sealed housing space and is arranged so that regardless of the position of the drilling or chipping device, it is not flooded by the lubricating oil and the lubricating oil does not flow out of the stilling chamber through the nozzle bore.

3 Claims, 1 Drawing Figure

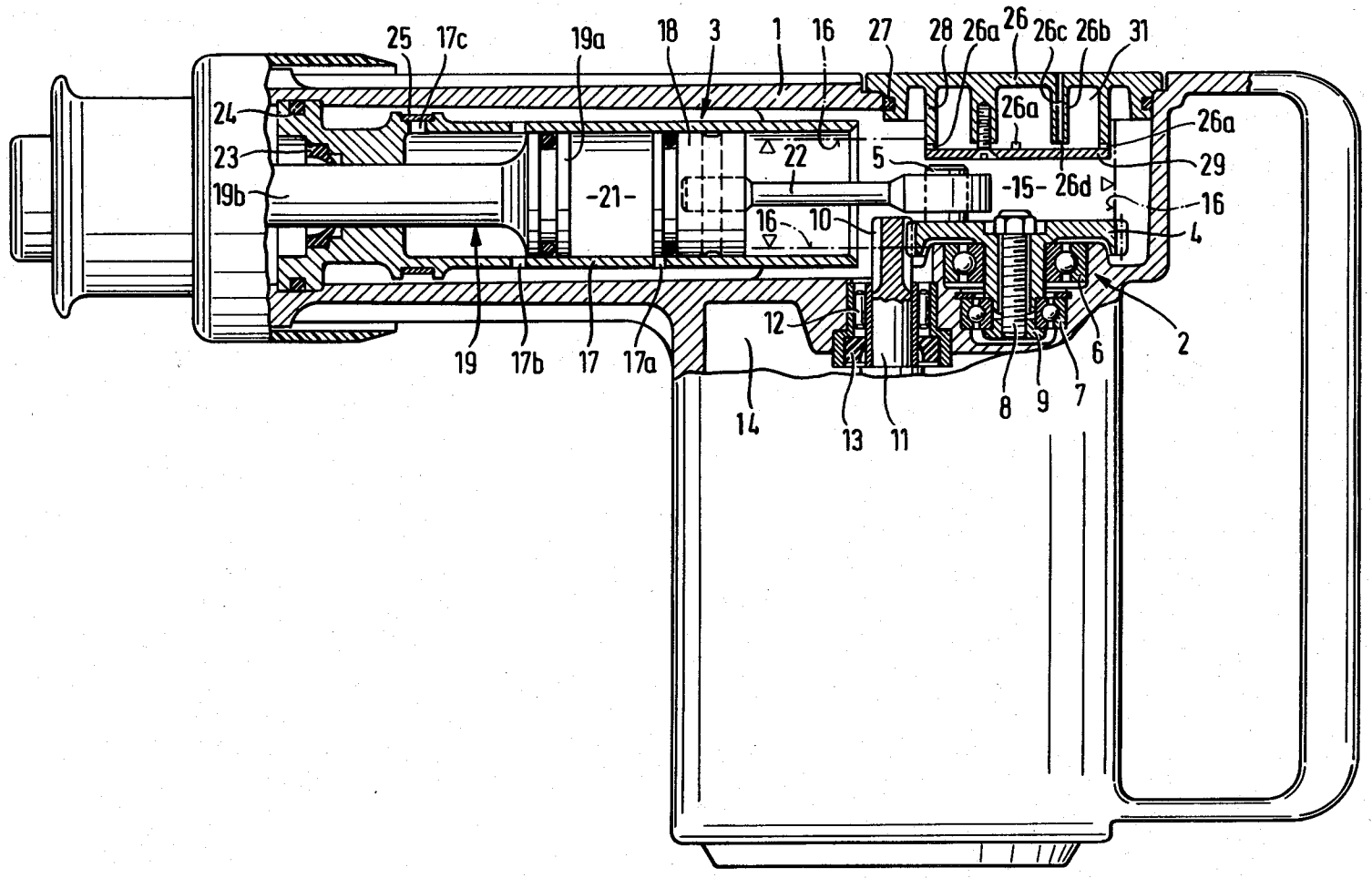
31
26b
26c
26
26a
28
27
16
1
3
18
19a
17c
25
24
23
19b
26a
29
16
4
26d
-15-
26a
26a
5
22
16
-21-
2
6
7
9
8
10
11
13
12
14
17a
17
17b
19

MOTOR DRIVEN DRILLING OR CHIPPING DEVICE

SUMMARY OF THE INVENTION

The present invention is directed to a motor driven drilling or chipping device including a housing containing a gear arrangement and an air cushion propulsion mechanism driven by the gear arrangement. Both the gear arrangement and the air cushion propulsion mechanism are positioned in a sealed housing space within the housing and this space is partially filled with lubricating oil and a pressure equalizing nozzle communicates with the housing space.

During the operation of drilling and chipping devices, excess pressure develops within the housing space containing the gear arrangement and the air cushion propulsion mechanism and the excess pressure is generated by heat. In addition, the housing space is exposed during the operation of the device to strong pressure fluctuations resulting from the movement of the parts forming the propulsion mechanism.

Such pressure conditions have resulted in considerable sealing problems in known devices. Experience has indicated that the seals used only function inadequately, particularly during long periods of operation of the device. As a result, lubricating oil may leak out of the sealed housing space and enter parts of the device located contiguous to the housing space. Such leakage is undesirable.

To counteract these problems in a known device the housing space is connected with another space in the housing by a pressure equalizing nozzle which opens into the housing space via a bore. Excess pressure developed in the housing space during the operation of the device increases more slowly due to the connection with the additional space and sealing problems develop only after a longer duration of operation. Further, peaks in the pressure fluctuation caused by the propulsion mechanism are damped due to the connection between the housing space and the additional space. In particular, during longer operational periods of a device with the excess pressure being developed due to heat, the pressure level damped in this manner impairs the sealing of the housing space.

Therefore, the primary object of the present invention is to provide a drilling or chipping device of the type described above with an effective ventilation of the housing space which reduces the pressures in the housing space,resulting due to operation, to a level which no longer impairs the sealing of the housing space.

In accordance with the present invention, the ventilation is effected via a pressure equalizing nozzle in communication between the ambient atmosphere outside the housing and the sealed housing space.

With the connection of the housing space, according to the invention, to the atmosphere, a continuous pressure equalization is effected so that only such pressures occur in the housing space which do not impair its seal. The connection of the nozzle bore to the atmosphere is provided advantageously by one or more pressure equalizing nozzles in the form of tubes. To protect the housing space from dirt entering from the exterior of the housing, a filter may be placed into the bore of the pressure equalizing nozzle.

To level off high pressure peaks, preferably the port of the pressure equalizing nozzle connected to the atmosphere and communicating with the housing space is enclosed by walls forming a stilling chamber. The stilling chamber is open to the housing space and pressure waves developed by the propulsion mechanism can be damped to a great extent in the stilling chamber. Any lubricating oil which may flow in the compressed air stream from the sealed housing space into the stilling chamber settles out within the stilling chamber and is collected for return to the housing space containing the gear arrangement and the air cushion propulsion mechanism.

Advantageously, the walls forming the stilling chamber have openings communicating with the housing space and these openings are not flooded or closed by the lubricating oil in any position of the device. Such openings permit pressure equalization between the stilling chamber and the housing space and, in addition, assure that any lubricating oil entering the stilling chamber in compressed air, is collected in the chamber and returned to the housing space. The openings between the stilling chamber and the housing space are located so that no lubricating oil can flow directly through the openings into the stilling chamber.

Another feature of the invention is that the openings are arranged at the bottom of the stilling chamber when the housing of the drilling device is held in the normal upright operating position. Such an arrangement ensures that in practically any position of the device, the oil accumulating in the stilling chamber will flow back into the housing space. Preferably, the openings are located in what is normally the bottom region of the walls forming the stilling chamber. Furthermore, the port in the pressure equalizing nozzle opening into the stilling chamber is located adjacent to the bottom of the chamber.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which where are illustrated and described preferred embodiments of the invention.

BRIEF DESCRIPTION OF THE DRAWING

The drawing is a side elevational view, partly in section, of a drilling or chipping device embodying the present invention.

DETAILED DESCRIPTION OF THE INVENTION

In the drawing a chipping device is shown in side elevation, partly in section with the working or front end of the device being located at the left-hand side and the rear or handle end of the device at the right-hand side. The upper side of the device is shown at the top, that is, in the normal operating position of the device. The chipping device includes a housing 1 containing a gear arrangement 2 located toward the rear part of the housing, and an air cushion propulsion mechanism 3 located in the barrel part of the housing so that it can operate a tool at the front or left-hand end of the housing.

The gear arrangement comprises essentially a gear wheel 4 with a crankpin 5 projecting upwardly from the gear wheel and located eccentrically on the gear wheel. Gear wheel 4 is rotatably supported within the housing by two ball bearings 6,7 and it is braced in the axial direction by a tightening bolt 8 and a support ring 9. The axis of rotation of the gear wheel 4 extends transversely of the axis of movement of the air cushion propulsion device 3. A pinion 10 is.located at the end of a rotor shaft 11 of an electric motor, not shown, but located in the lower part of the housing just in front of the handle part. The pinion 10 meshes with the gear wheel 4 and drives the gear wheel. The rotor shaft 11 is rotatable within the lower part of the housing within a roller bearing 12. A sealing ring 13 located just below the roller bearing 12 extends laterally around the rotor shaft 11 and prevents any flow of lubricating oil from the housing space 15 into the motor space 14. The housing space 15 located above the motor space 14 in the barrel part of the housing 1 contains the gear arrangement 2 and the air cushion propulsion mechanism 3. The lubricating oil only partially fills the housing space 15 and the level of the lubricating oil in the different positions of the device is identified by the dot-dash lines 16.

As can be seen in the sectioned portion of the drawing, the air cushion propulsion mechanism 3 is formed of an axially elongated guide cylinder 17 extending in the front end-rear end direction of the housing. An exciter piston 18 is located in the rear portion of the cylinder spaced behind a percussion piston 19. An air cushion 21 is formed between the front side of the exciter piston 18 and the rear side of the percussion piston 19. A connecting rod 22 is positioned on the crankpin 5 and extends forwardly into connection with the exciter piston and as the crankpin rotates with the gear wheel 4 it drives the exciter piston 18 in a reciprocating manner within the guide cylinder 17. Percussion piston 19 includes a head **19*a* at its rear end with a reduced diameter shaft 19*b*, as compared to the head, extending forwardly from the head through the guide cylinder toward the front end of the housing 1. Both the exciter piston 18 and the percussion piston head 19*a* are disposed in sealed engagement with the inside surface of the guide cylinder 17. At the forward end of the guide cylinder 17, sealing elements 23,24 provide a seal for the front end portion of the housing space 15. The sealing element 23 is in sealing contact with the surface of the shaft 19*b* while the sealing element 24 forms a seal between the outside surface of the guide cylinder 17 and the housing 1. At spaced locations along the axial direction of the guide cylinder 17, openings 17*a*, 17*b*, 17*c* are provided for effecting the reciprocating action of the air cushion propulsion mechanism 3. A valve ring 25 is located in the opening 17*c* adjacent the front end of the guide cylinder 17**.

Toward the rear end of the housing 1, spaced upwardly from the gear arrangement 2, a plate-shaped or shallow cylinder shaped insert 26 is provided in the housing and a rubber ring 27 inserted into the sides of the insert serves as a seal around its circumferential surface with the juxtaposed surface of the housing 1. In addition to the plate-like portion located in the outer surface of the housing 1, the insert 26 has an annular wall 28 extending inwardly into the housing space 15 and forming in combination with a bolt attached cover plate 29, a stilling chamber 31. The cover plate 29 is spaced inwardly from the outside surface of the housing and, as viewed in the drawing, is spaced upwardly from the gear wheel 4 and from the crankpin 5 extending upwardly from the gear wheel. A number of openings **26*a* are located in the lower end of the annular wall 28 at its junction with the cover plate 29 and form communication between the inside of the stilling chamber 31 and the housing space 15. As a result, the inside of the housing space 15 and the stilling chamber 31 are in flow communication. A pressure equalizing nozzle 26*b* with an axially extending bore 26*c* extends downwardly from the upper part of the insert 26, as viewed in the drawing, to a point spaced closely above the cover plate 29. The bore 26*c* within the nozzle 26*b* opens into the lower portion of the stilling chamber. Further, the bore opens through the insert to the outside of the housing 1 so that it communicates between the ambient atmosphere about the housing and through the port 26*b* with the interior of the stilling chamber 31**.

During operation of the chipping device, heat is generated and the reciprocating movement of the exciter piston 18 and the percussion piston 19 causes continuous pressure fluctuations within the housing space 15. To a great extent these pressure fluctuations are equalized in the stilling chamber 31 where the pressure waves are damped. The lubricating oil located within the housing space 15 can flow with the air compressed in the housing space through the openings **26*a* into the stilling chamber 31 where the oil precipitates. Depending on the position of the device, the lubricating oil within the stilling chamber can flow back into the housing space through at least one of the openings 26*a*. It can be appreciated from the position shown in the drawing, that the lubricating oil located on the surface of the cover plate 29 within the stilling chamber 31 will be able to flow through the openings 26*a* back into the housing space 15. Further, the stilling chamber 31 is in flow communication with the ambient atmosphere outside of the housing 1 through the port 26*d* and the bore 26*c* through the pressure equalizing nozzle 26*b* so that any pressure differences existing within the stilling chamber can be decreased. None of the lubricating oil which finds its way into the stilling chamber 31 flows through the bore 26*c* to the outside of the housing 1**.

While specific embodiments of the invention have been shown and described in detail to illustrate the application of the inventive principles, it will be understood that the invention may be embodied otherwise without departing from such principles.

I claim:

1. A motor driven drilling or chipping device comprising a housing, a gear arrangement mounted in said housing, an air cushion propulsion mechanism located within said housing and driven by said gear arrangement, said housing including a sealed housing space containing said gear arrangement and said air cushion propulsion mechanism, said sealed housing space being partly filled with lubricating oil so that in any position of said device an oil level is formed in said sealed housing, an elongated pressure equalizing nozzle projecting through said housing into said housing space, said nozzle forming a passageway having a first end open to the ambient atmosphere outside said housing and an opposite second end open to said housing space whereby the ambient atmosphere has access to said sealed housing space only through said nozzle, and the second end of said nozzle is arranged within said housing space so that the nozzle is not flooded by the lubricating oil in any position of the device, wall means are mounted in said housing and form a stilling chamber, said equalizing nozzle extends into said stilling chamber with said second end of said nozzle open to said stilling chamber, said housing has a front end and a rear end with said air cushion propulsion mechanism arranged to operate a working tool at the front end of said housing, said housing forming a barrel-like portion enclosing said air cushion propulsion mechanism and having an upper surface and a lower surface, said housing forming a motor space projecting downwardly from the lower surface, said motor space located adjacent the rear end of said housing below said housing space, means for sealing said motor space from said housing space so that the lubricating oil is prevented from flowing from said housing space into said motor space, said housing has an opening in said upper surface thereof adjacent the rear end of said housing and spaced upwardly from said motor space, said wall means forming said stilling chamber located within said opening in said housing and disposed in sealed engagement with said housing, said wall means extending into said housing space and comprising a plate-like member disposed in alignment with the outer surface of said housing, an annular wall extending downwardly from said plate-like member into said housing space, a cover plate secured to said annular wall within said housing space and forming a closure for the lower end of said stilling chamber, said plate-like member, said annular wall and said cover plate defining said stilling chamber, openings located in the lower end of said annular wall at the juncture of said annular wall with said cover plate so that said openings communicate between the interior of said stilling chamber and said housing space, and said nozzle extending through said plate-like member into said stilling chamber whereby said housing space is in communication with the ambient atmosphere through said nozzle and stilling chamber.

2. A motor driven drilling or chipping device, as set forth in claim 1, wherein said cover plate is spaced upwardly from and opposite said gear arrangement.

3. A motor driven drilling or chipping device, as set forth in claim 1 wherein said first end of said pressure equalizing nozzle is connected to said plate-like member and said nozzle extends downwardly from said plate-like member to a position with the second end thereof closely spaced from said cover plate and said nozzle forms a bore extending from the first end thereof through said plate-like member to the second end thereof within said stilling chamber.

* * * * *